US007612546B2

(12) United States Patent
Leith et al.

(10) Patent No.: US 7,612,546 B2
(45) Date of Patent: Nov. 3, 2009

(54) CONFIGURABLE INTERNAL/EXTERNAL LINEAR VOLTAGE REGULATOR

(75) Inventors: James W. Leith, Seattle, WA (US); Gustavo J. Mehas, Mercer Island, WA (US); Bogdan Duduman, Raleigh, NC (US)

(73) Assignee: Intersil Americas Inc., Milpitas, CA (US)

( * ) Notice: Subject to any disclaimer, the term of this patent is extended or adjusted under 35 U.S.C. 154(b) by 217 days.

(21) Appl. No.: 10/919,152

(22) Filed: Aug. 16, 2004

(65) Prior Publication Data

US 2005/0206355 A1 Sep. 22, 2005

Related U.S. Application Data

(60) Provisional application No. 60/553,489, filed on Mar. 16, 2004.

(51) Int. Cl.
*G05F 1/40* (2006.01)

(52) U.S. Cl. ..... 323/273

(58) Field of Classification Search ..... 323/273, 323/274, 275, 276

See application file for complete search history.

(56) References Cited

U.S. PATENT DOCUMENTS

| | | | | | |
|---|---|---|---|---|---|
| 5,258,653 | A * | 11/1993 | Perry | 307/74 |
| 5,525,895 | A * | 6/1996 | Fishman | 323/268 |
| 5,528,127 | A * | 6/1996 | Streit | 323/269 |
| 5,629,609 | A * | 5/1997 | Nguyen et al. | 323/269 |
| 6,005,303 | A * | 12/1999 | Hawkes et al. | 307/44 |
| 6,175,222 | B1 * | 1/2001 | Adams et al. | 323/270 |
| 6,175,223 | B1 * | 1/2001 | Martinez et al. | 323/274 |
| 6,232,754 | B1 * | 5/2001 | Liebler et al. | 323/272 |
| 6,452,368 | B1 * | 9/2002 | Basso et al. | 323/282 |
| 6,472,857 | B1 * | 10/2002 | Genest et al. | 323/303 |
| 6,583,520 | B2 * | 6/2003 | Shi et al. | 307/33 |
| 6,654,264 | B2 * | 11/2003 | Rose | 363/65 |
| 6,803,672 | B2 * | 10/2004 | Gunasekera | 307/9.1 |

* cited by examiner

*Primary Examiner*—Adolf Berhane
(74) *Attorney, Agent, or Firm*—Howison & Arnott, L.L.P.

(57) ABSTRACT

A voltage regulator includes a voltage source for providing an input voltage. The regulator includes circuitry responsive to the input voltage for generating a regulated output voltage. The circuitry enables selection of one of internal linear voltage regulation or external linear voltage regulation for generating the regulated output voltage.

15 Claims, 5 Drawing Sheets

CONFIGURABLE INTERNAL/EXTERNAL LINEAR VOLTAGE REGULATOR

CROSS-REFERENCE TO RELATED APPLICATIONS

This application claims priority from U.S. Provisional Application Ser. No. 60/553,489 entitled "CONFIGURABLE INTERNAL/EXTERNAL LINEAR VOLTAGE REGULATOR".

TECHNICAL FIELD OF THE INVENTION

The present invention relates to voltage regulators, and more particularly, to a voltage regulator that has a user programmable internal pass/external pass feature.

BACKGROUND OF THE INVENTION

Every electronic circuit is designed to operate off of some supply voltage, which is usually assumed to be constant. A voltage regulator provides this constant DC output voltage and contains circuitry that continuously holds the output voltage at a regulated value regardless of changes in a load current or input voltage. A linear voltage regulator operates by using a voltage controlled current source to output a fixed voltage. A control circuit must monitor the output voltage, and adjust the current source to hold the output voltage at the desired value.

One of the problems that a wide range input voltage, such as 3v to 20v, places on a linear voltage regulator is thermal stress when operating at high input supply voltage while providing a low output voltage. This is further compounded when the linear regulator is only one aspect of the total chip functionality, and the total thermal budget cannot be used up by the Linear Regulator. Most of the thermal stress is on the current source and the exact magnitude of the problem is very application specific. The easiest way to control the problem is to control the current source by allowing it to be either internal or external. Existing linear voltage regulators are unable to be configured with either internal or external current sources.

SUMMARY OF THE INVENTION

The present invention disclosed and claimed herein, in one aspect thereof, includes a voltage regulator that is capable of operating with either an internal voltage regulator or an external voltage regulator. The regulator includes a voltage source for providing an input voltage. Circuitry responsive to the input voltage generates a regulated voltage output. The circuitry enables selection of one of an internal linear voltage regulator for internal linear voltage regulation or an external linear voltage regulator for external linear voltage regulation for generating the regulated voltage output.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Every electronic circuit is designed to operate off of some voltage supply, which is usually assumed to be constant. A voltage regulator provides a constant DC output voltage and contains circuitry that continuously holds the output voltage at the designed value regardless of changes in an applied load current or applied input voltage.

Figure 1:
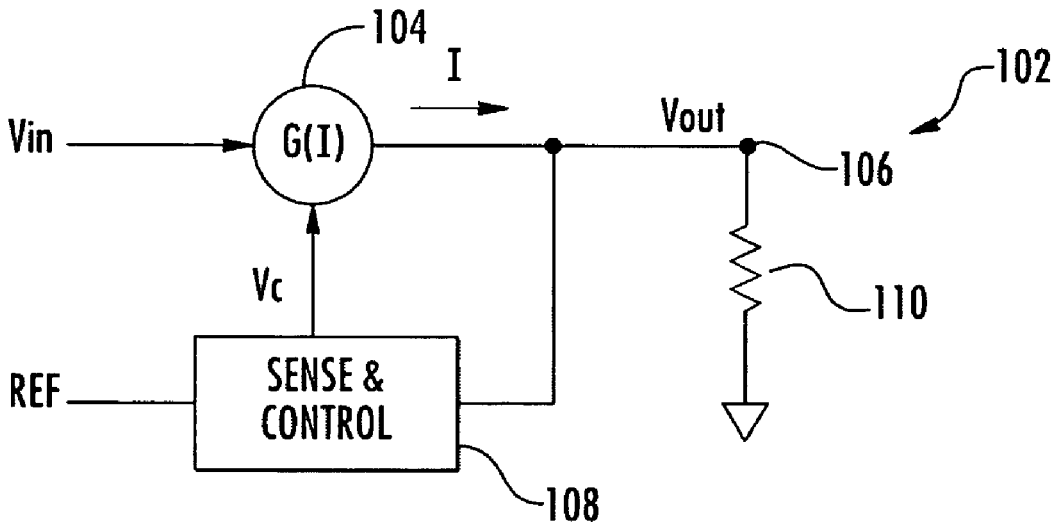
FIG. 1 is a block diagram of a linear voltage generator.

Referring now to FIG. 1, there is illustrated a basic linear voltage regulator 102. A linear voltage regulator 102 operates by using a voltage controlled current source 104 to force a fixed voltage to appear at the regulator output node 106. The sense and control circuitry 108 monitors or senses the output voltage at node 106, and adjusts the current source 104 using a control voltage $V_C$ to hold the output voltage at the desired value. The design limit of the current source defines the maximum load current the regulator can provide and still maintain voltage regulation.

The voltage regulator 102 has two limitations when operating as an internal voltage regulator. An internal voltage regulator provides voltage regulation wherein the current source 104 resides within the voltage regulation device. For an external voltage regulator, the current source 104 will be located somewhere outside of the voltage regulation device. The maximum output current ($I_{MAX}$) of the current source 104 can be limited due to the area on the chip used by the current source 104. Thus, if additional current is needed once the internal voltage regulator is providing a maximum current value enabled by its area, this is not possible. Internal voltage regulators may further be limited by thermal limitations required to dissipate energy generated by the current source 104. In the situation where the input voltage $V_{IN}$ varies from 3 V-20 V, the voltage regulator 102 may exceed the particular thermal limits for the internal linear voltage regulator 102 at the higher voltage levels. For example, if the input voltage equals 20 V, the output voltage $V_{OUT}$ equals 5.5 V and the current provided through load 110 will equal 100 mA. The power provided by the current source 104 equals 1.45 watts. It would be difficult for an internal linear voltage regulator 102 to dissipate this much power. Thus, there is a need to provide a user with the flexibility to utilize an external device instead of an internal linear voltage regulator in order to move power dissipation off of the chip to prevent an internal linear voltage regulator from exceeding its current limits and to provide additional current when an area of an internal regulator limits further current increases.

Figure 2:
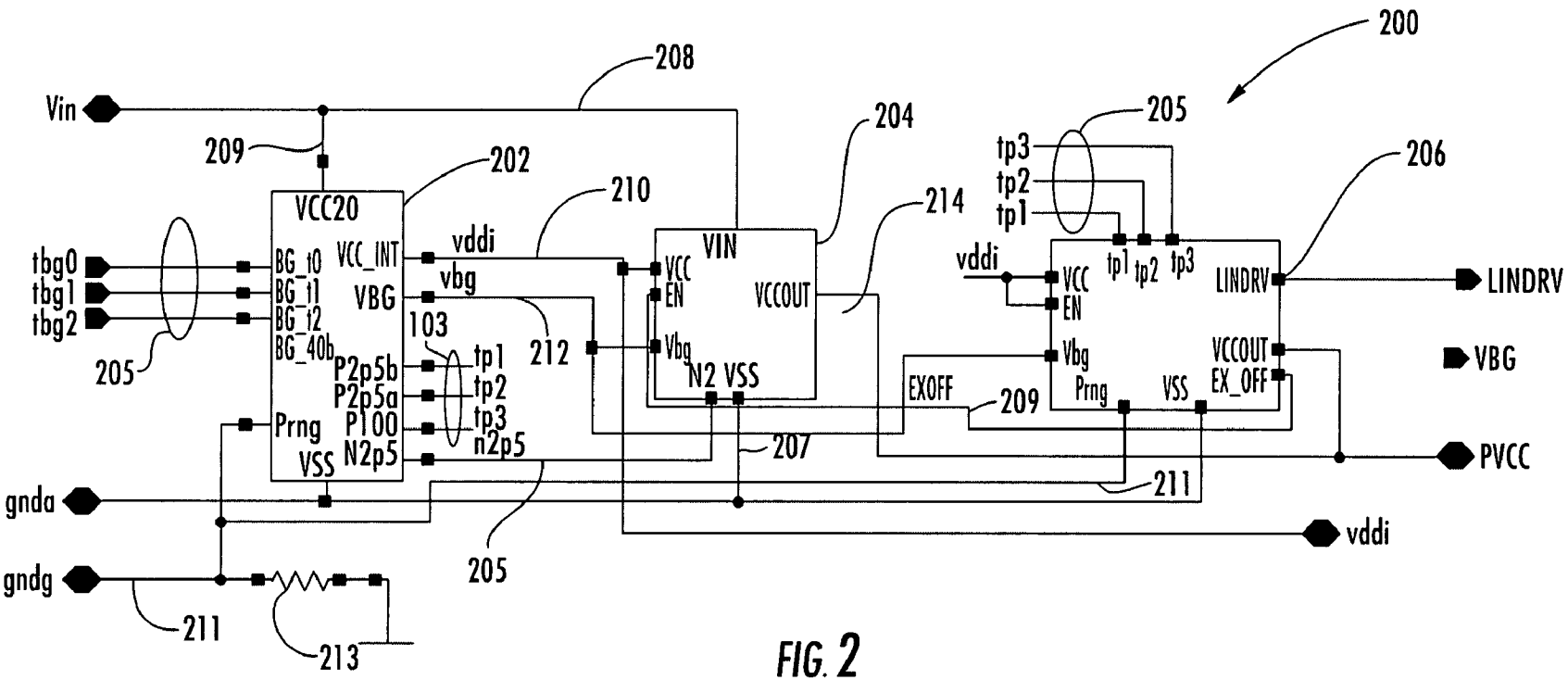
FIG. 2 is a block diagram illustrating a configurable internal/external linear voltage regulator.

The circuitry for implementing a configurable internal/external linear voltage regulator is illustrated in FIG. 2. The configurable internal/external linear voltage regulator 200 contains three circuit blocks including a band-gap generator 202, an internal pass linear voltage regulator 204 and a differential amplifier sub-block 206 used for an external pass linear voltage regulator. The band-gap generator 202 provides a reference band-gap voltage and reference currents via a number of pin outputs. Three pin inputs BG_T0, BG_T1 and BG_T2 provide trim bit inputs via lines 205 to trim the band-gap voltage provided by the band-gap generator 202. The band-gap generator 202 is connected to the system power bus via a pin VCC30 that is connected to the power bus 208 via line 209. Pin VCC_INT of the band-gap generator 202 provides a reference voltage vddi via line 210. A band-gap reference voltage is provided from pin VBG over line 212. Additionally, the band-gap generator provides a number of reference currents via lines 213 from pin outputs P2*p*5*b*, P2*p*5*a* and P100. Output pin VSS of the band-gap generator 202 is connected to the system ground GNDA. Output pin PRNG of the band-gap generator 202 is connected to input line prng 211 and is connected to ground through resistor 213.

The internal voltage regulator 204 provides internal voltage regulation in the manner described above with respect to FIG. 1. The VIN pin of the internal voltage regulator 204 is connected directly to the power bus 208. The VBG pin is connected to receive the band-gap reference voltage from the band-gap generator 202 via line 212. The N2 pin of the internal voltage regulator 204 is connected to the N2P5 pin of the band-gap generator 202 via line 205. The VSS pin is connected to ground via line 207. The regulated output voltage of the internal voltage regulator 204 is provided through pin VCC_OUT over power bus 214. The internal voltage regulator 204 is enabled and disabled via pin EN connected to line 209.

The differential amplifier sub-block 206 for an external linear voltage regulator is connected to lines 205 to receive the three reference currents from the band-gap generator 202 at pin inputs IP1, IP2 and IP3. Additionally, the differential amplifier 206 sub-block is connected to line 212 to receive the band-gap reference voltage at pin Vbg. The VCC and enable (EN) pins of the differential amplifier 206 are connected to vddi. The prng pin is connected the prng input via line 211, and pin VSS is connected to line 207 and the ground input. The output of the differential amplifier sub-block 206 is connected to the regulated voltage output line 214. The LINDRV pin is used to enable and disable the internal linear voltage regulator 204 by selectively grounding the pin when use of the internal linear voltage regulator 204 is desired. When the LINDRV pin is grounded, an enable output is applied from the EX_OFF pin via line 209 to the EN input of the internal linear voltage regulator 204 that enables the internal linear voltage regulator such that the internal linear voltage regulator regulates the input voltage applied via the input bus 208 and provides an output of the regulated voltage over line 214. When the LNDRV pin is not grounded, the differential amplifier sub-block 206 acts as an amplifier output for an external linear voltage regulator element. A user might select the use of an external linear voltage regulator element to reduce thermal dissipation that is required to occur upon the integrated circuit containing the internal linear voltage regulator element. In high voltage applications, the internal linear voltage regulator would be required to dissipate close to 1.5 watts of power as discussed previously with respect to FIG. 1. By disabling the internal linear voltage regulator source and attaching an external linear voltage regulator source via differential amplifier sub-block 206, an external linear voltage regulator including a heat sink may be connected to the circuit for dissipating power at these levels off of the chip rather than on the chip.

Figure 3A:
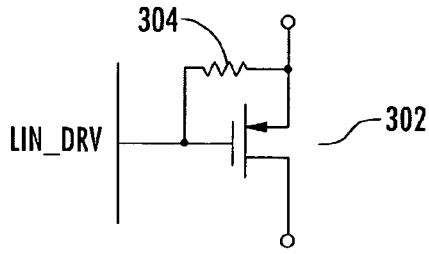
FIGS. 3*a* and 3*b* illustrate the manner in which the LIN_DRV pin is connected with respect to operation as an external linear voltage regulator.
Figure 3B:
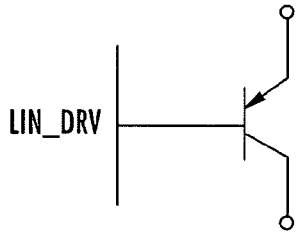

The LINDRV pin should be connected to ground when using an external 5 V power supply or when using the internal linear regulator. Referring now to FIGS. 3*a* and 3*b*, when using an external linear regulator, the LINDRV pin is connected to the gate of a PMOS device 302, and a resistor 304 should be connected between the gate and source of the PMOS device 302. Alternatively, a PNP device 306 can be used instead of a PMOS device 302. In this case, the LINDRV pin should be connected to the base of the PNP device 306. The PNP device illustrated in FIG. 3*b* is turned on by current. The PMOS device 302 illustrated in FIG. 3*a* is turned on by voltage. Thus, a current output must be provided from the LINDRV pin of the differential amplifier sub-block 206. This provides the user with the ability to compensate for the provided current and the user may convert the current to a voltage by using a resistor.

Figure 4:
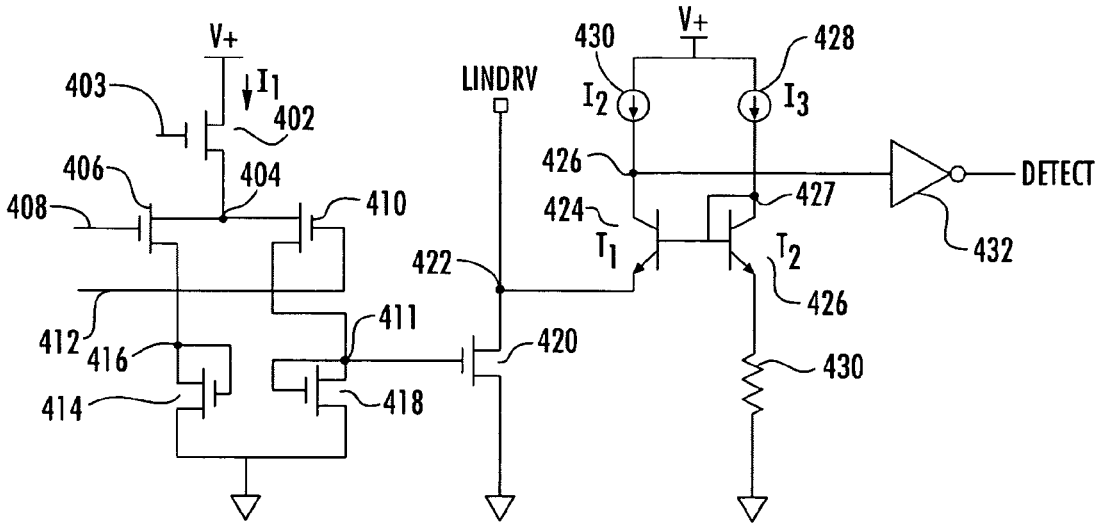
FIG. 4 is a schematic diagram of one embodiment of a simple transconductance amplifier for use within the configurable linear voltage regulator of FIG. 2.

Referring now to FIG. 4, there is illustrated one example of the circuitry which may be implemented within the differential amplifier sub-block 206. In this case, a single stage amplifier is illustrated. The amplifier consists of a transistor 402 having its drain/source path connected between V+ and node 404. The gate of the transistor 402 is connected to an input 403. Transistor 406 is connected between node 404 and node 416. The gate of transistor 406 is connected to input line 408. Transistor 410 has its drain/source path connected between nodes 404 and 411. The gate of transistor 410 is connected to input line 412. Transistor 414 has its drain/source path connected between node 416 and ground. The gate of transistor 414 is also connected to node 416. Transistor 418 has its drain/source path connected between node 411 and ground. The gate of transistor 418 is connected to the gate of transistor 420. Transistor 420 has its drain/source path connected between node 422 and ground. Node 422 is connected to the pin LINDRV. Transistor 424 has its drain/source path connected between node 426 and node 422. The gate of transistor 424 is connected to the gate of transistor 426. Additionally, the drain/source path of transistor 426 is connected between node 427 and ground through a resistor 430. Additionally, the gate of transistors 426 and 424 are connected to node 427. A current source $I_2$ 431 resides between V+ and node 426. A second current source $I_3$ 428 resides between V+ and node 427. Node 426 is also connected to the input of inverter 432. The output of inverter 432 provides a detect signal that is applied to output pin EX_OFF of the differential amplifier sub-block 206 to enable or disable the internal linear voltage regulator 204. When the LINDRV pin connected to node 422 is grounded, transistor 424 will be on and can overcome current 12 causing the output of inverter 432 to be logically high. This logical high signal is used to enable the internal linear voltage regulator 204.

Figure 5:
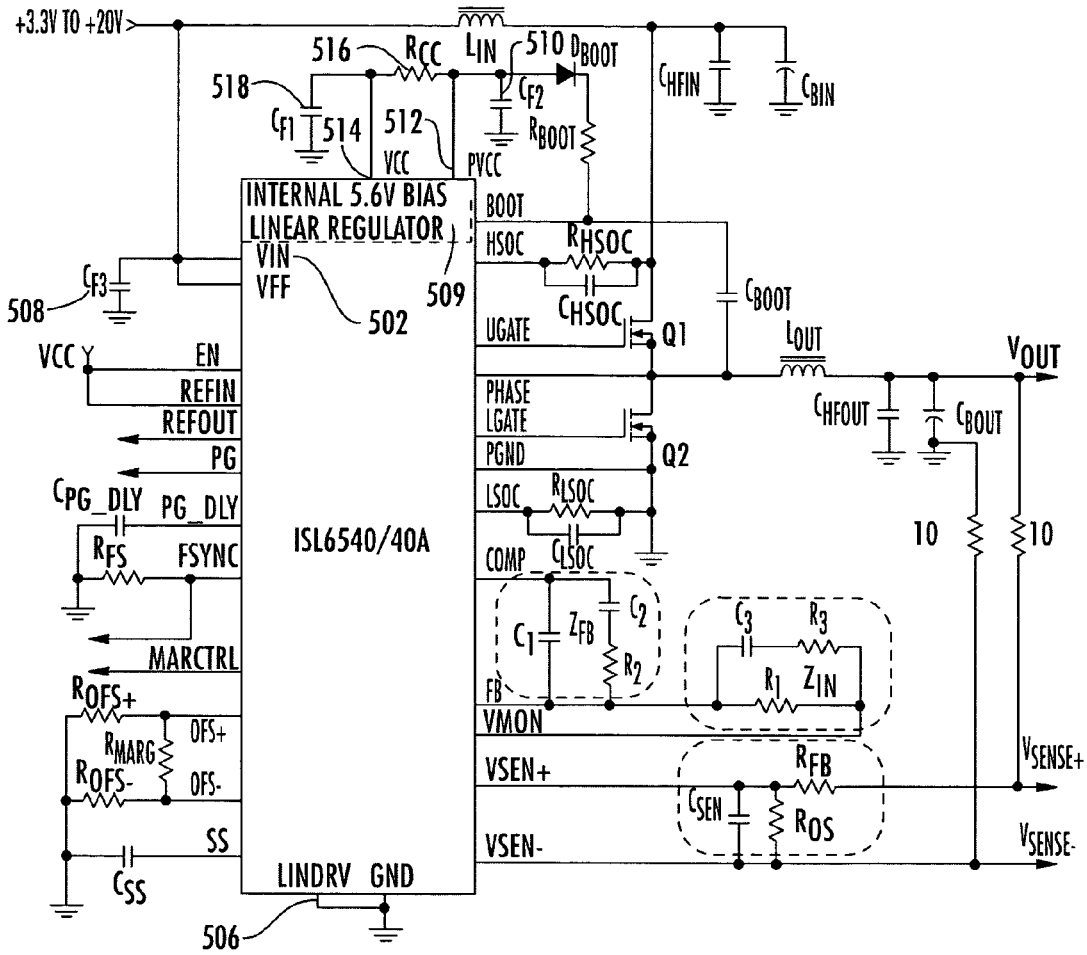
FIG. 5 is a schematic diagram of the linear voltage regulator configured as an internal linear voltage regulator.

Referring now to FIG. 5, there is illustrated a voltage regulator configured to operate as an internal linear voltage regulator according to the present disclosure. The VIN pin 502 is connected to PVCC which may be varied anywhere from 3.3 V to 20 V with a two ohm internal series linear regulator 504, which is internally compensated. The external series linear regulator option is used for applications requiring pass elements of less than two ohms. When using the internal regulator 504, the LIN_DRV pin 506 is connected directly to GND. The PVCC and VIN pins include bypass capacitors, 508 and 510, respectively, connected to ground for buffer operation. The input (VIN) of internal series linear regulator 504 can range from 3.3 V to 20 V. The internal linear regulator 504 provides power for internal MOSFET drivers through the PVCC pin 512 and to the analog circuitry through the VCC pin 514. The VCC pin 514 is connected to the PVCC pin 512 via an RC filter to prevent high frequency driver switching noise from entering the analog circuitry. The RC filter consists of resistor 516 connected between the VCC and PVCC pins and capacitor 518 connected between pin VCC 514 and ground. When the VIN pin 502 drops below 5.6 volts, the pass element will saturate, PVCC 512 will track VIN, minus the drop out of the linear regulator: PVCC=VIN−2·$I_{VIN}$. When used with an external 5 V supply, the VIN pin should be tied directly to the PVCC pin.

Figure 6:
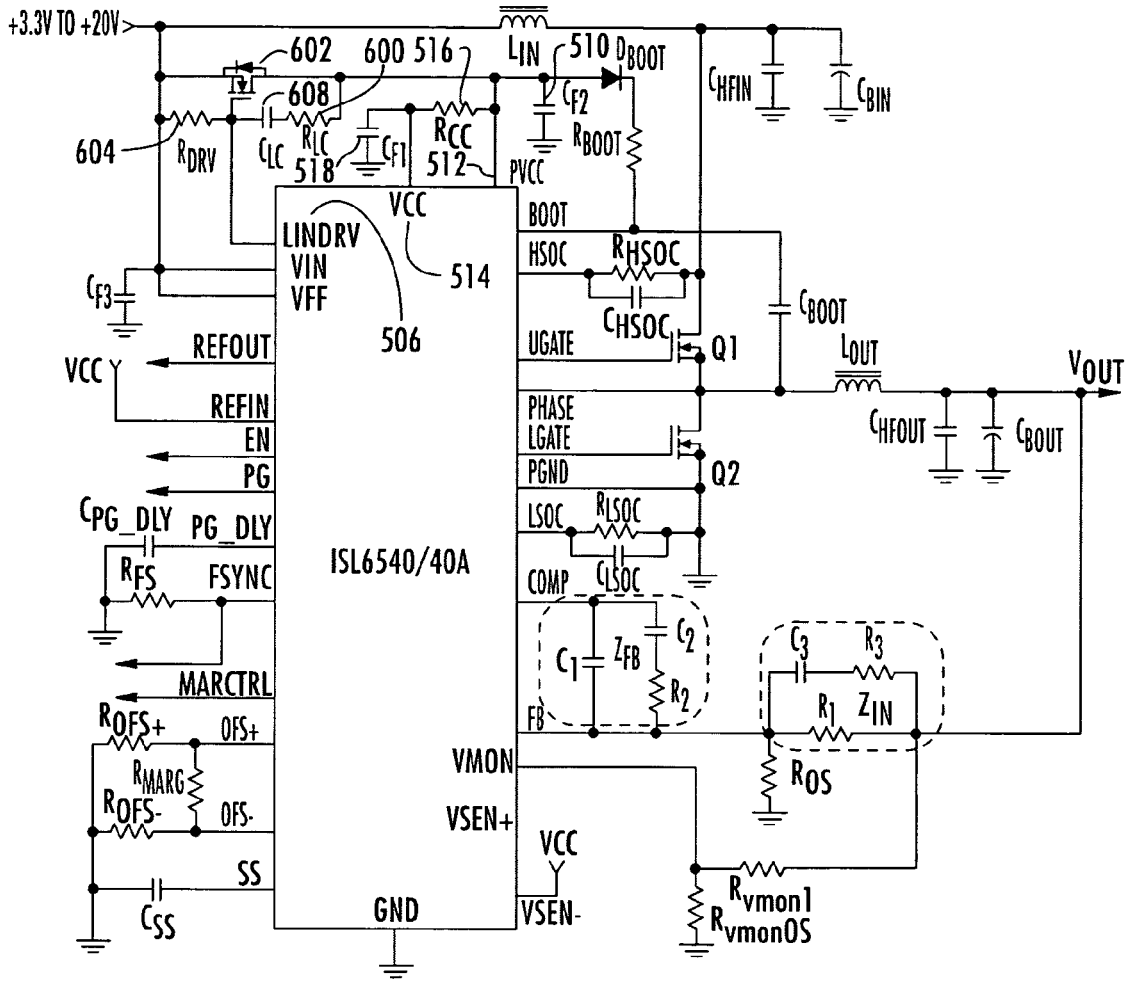
FIG. 6 is a schematic diagram of the voltage regulator configured as an external linear voltage regulator.

Referring now to FIG. 6, there is illustrated a voltage regulator operating using an external linear regulator. The LIN_DRV pin 506 provides the syncing drive capability for an external pass element linear regulator controller. The external linear operations are especially useful when the internal linear dropout is too large for a given application. When using the external linear regulator option, the LIN_DRV pin 506 is connected to the gate of a PMOS device 602, and a resistor 604 should be connected between its gate and source. A resistor 606 and a capacitor 608 should be connected from gate to drain or gate to source as necessary to compensate the control loop. As discussed herein above, a PNP device can be used instead of a PMOS device, in which case the LIN_DRV pin 506 should be connected to the base of the PNP pass element. The maximum syncing capability of the LIN_DRV pin 506 is 2 mA, and should not be exceeded if using an external resistor for a PMOS device. The VCC pin 514 should be connected to the PVCC pin 512 with an RC filter to prevent high frequency driver switching noise from entering the analog circuitry. The RC filter consists of a resistor 516 and a capacitor 518.

By combining an internal pass linear regulator and the option for a user programmable external pass linear regulator utilizing an external PMOS or PNP pass element, a user is able to selectively reduce the thermal dissipation that must be carried out on an integrated circuit. Thus, for a high voltage application, the internal linear regulators would not be required to dissipate close to 1.5 watts of power, but instead may choose to use an external linear regulator with a heat sink. Alternatively, for applications requiring a higher maximum current than can be provided by an internal linear regulator due to size limitations of the device, the ability to choose an external regulator is beneficial. This will provide the ability for the linear regulator to operate over a supply range of 3 V to 20 V.

Although the preferred embodiment has been described in detail, it should be understood that various changes, substitutions and alterations can be made therein without departing from the spirit and scope of the invention as defined by the appended claims.

What is claimed is:

1. A voltage regulator implemented on a single integrated circuit, comprising:

a voltage source input for receiving an input voltage;

an internal linear voltage regulator connected to receive the input voltage for providing internal linear voltage regulation;

a first circuit for disabling the internal linear voltage regulator and enabling the voltage regulator to operate using external linear voltage regulation in a first selected mode of operation, and for enabling the internal voltage regulator and disabling the voltage regulator to operate using the external linear voltage regulation in a second selected mode of operation wherein the first circuit of the voltage regulator is user configurable to the first mode or the second mode of regulation.

2. The voltage regulator of claim 1, wherein the first circuit comprises a differential amplifier sub-block for selectively disabling the internal linear voltage regulator and providing an output to an external linear voltage regulator.

3. The voltage regulator of claim 1, wherein the first circuit enables the internal linear voltage regulator and disables external linear voltage regulation responsive to grounding of a pin associated with the first circuit for selectively disabling.

4. The voltage regulator of claim 1, wherein the first circuit disables the internal linear voltage regulator and enables external linear voltage regulation responsive to connection of a pin associated with the first circuit for selectively disabling to a PNP device.

5. The voltage regulator of claim 1, wherein the first circuit disables the internal linear voltage regulator and enables external linear voltage regulation responsive to connection of a pin associated with the first circuit for selectively disabling to a PMOS device.

6. The voltage regulator of claim 1, wherein the first circuit further comprises:

a band-gap generator for providing at least one reference voltage and one reference current;

wherein the internal linear voltage regulator is connected to receive the input voltage and to the band-gap generator for providing internal linear voltage regulation; and a differential amplifier sub-block for selectively disabling the internal linear voltage regulator and providing an output to an external linear voltage regulator in response to the user designated configuration.

7. The voltage regulator of claim 6, wherein the differential amplifier sub-block enables the internal linear voltage regulator and disables external linear voltage regulation in the selected second mode of operation responsive to grounding of a pin of the differential amplifier sub-block.

8. The voltage regulator of claim 6, wherein the differential amplifier sub-block disables the internal linear voltage regulator and enables external linear voltage regulation in the selected first mode of operation responsive to connection of a pin of the differential amplifier sub-block to a PNP device.

9. The voltage regulator of claim 6, wherein the differential amplifier sub-block disables the internal linear voltage regulator and enables external linear voltage regulation in the selected first mode of operation responsive to connection of a pin of the differential amplifier sub-block to a PMOS device.

10. A voltage regulator implemented on a single integrated circuit, comprising:

a voltage source for providing an input voltage;

an internal linear voltage regulator connected to receive the input voltage for providing internal linear voltage regulation; and a differential amplifier sub-block for selectively enabling the internal linear voltage regulator and disabling the voltage regulator to operate using external linear voltage regulation responsive to user configured grounding of a pin of the differential amplifier sub-block and for selectively disabling the internal linear voltage regulator and enabling the voltage regulator to operate using external linear voltage regulation responsive to user configured connection of the pin of the differential amplifier sub-block to at least one of a PNP device and a PMOS device.

11. The voltage regulator of claim 10, further comprising a band-gap generator for providing at least one reference voltage to the internal voltage regulator and the differential amplifier sub-block and at least one reference current to the differential amplifier sub-block.

12. An apparatus implemented on a single integrated circuit, comprising:

a voltage source input for receiving an input voltage;

a band-gap generator for providing at least one reference voltage and one reference current;

an internal linear voltage regulator connected to receive the input voltage and to the band-gap generator for providing internal linear voltage regulation; and a differential amplifier sub-block for selectively disabling the internal linear voltage regulator and providing an output to an external linear voltage regulator in a first mode of operation, the differential amplifier sub-block including a second mode of operation wherein the internal linear voltage regulator is enabled and an output to the external linear voltage regulator is not provided further wherein the first circuit of the voltage regulator is user configurable to the first mode or the second mode of regulation.

13. The voltage regulator of claim 12, wherein the differential amplifier sub-block enables the internal linear voltage regulator and disables external linear voltage regulation in the selected second mode of operation responsive to grounding of a pin associated with the differential amplifier sub-block.

14. The voltage regulator of claim 12, wherein the differential amplifier sub-block disables the internal linear voltage regulator and enables external linear voltage regulation in the selected first mode of operation responsive to connection of a pin associated with the differential amplifier sub-block to a PNP device.

15. The voltage regulator of claim 12, wherein the differential amplifier sub-block disables the internal linear voltage regulator and enables external linear voltage regulation in the selected first mode of operation responsive to connection of a pin associated with the differential amplifier sub-block to a PMOS device.

* * * * *